US008333542B2

(12) United States Patent
Carter et al.

(10) Patent No.: US 8,333,542 B2
(45) Date of Patent: Dec. 18, 2012

(54) BOOKBINDING PROCESS

(75) Inventors: Dave G. Carter, Chorleywood (GB); Malcolm Graham, Old Windsor (GB); Kim Tagesen, Viborg (DK)

(73) Assignee: Henkel AG & Co. KGaA, Duesseldorf (DE)

( * ) Notice: Subject to any disclaimer, the term of this patent is extended or adjusted under 35 U.S.C. 154(b) by 1219 days.

(21) Appl. No.: 10/000,763

(22) Filed: Oct. 24, 2001

(65) Prior Publication Data

US 2003/0077148 A1 Apr. 24, 2003

(51) Int. Cl.
*B42C 9/00* (2006.01)
*B42C 11/00* (2006.01)

(52) U.S. Cl. ..... 412/5; 412/8

(58) Field of Classification Search ..... 412/19, 412/21, 5; 156/331.4, 331.7, 332, 314, 315, 156/908, 310; 281/21.1, 15.1
See application file for complete search history.

(56) References Cited

U.S. PATENT DOCUMENTS

| | | | | | |
|---|---|---|---|---|---|
| 3,615,106 | A | * | 10/1971 | Flanagan | 281/21.1 |
| 3,739,412 | A | * | 6/1973 | Card et al. | 412/8 |
| 3,837,994 | A | * | 9/1974 | Flanagan | 428/122 |
| 3,840,254 | A | * | 10/1974 | Shatzkin | 281/21.1 |
| 4,140,733 | A | * | 2/1979 | Meyer et al. | 524/304 |
| 4,299,410 | A | * | 11/1981 | Jukola | 281/21.1 |
| 4,536,012 | A | * | 8/1985 | Hume, III | 281/21.1 |
| 4,660,858 | A | * | 4/1987 | Flanagan | 281/21.1 |
| 4,808,255 | A | * | 2/1989 | Markevka et al. | 156/307.3 |
| 4,907,822 | A | * | 3/1990 | Carter et al. | 281/15.1 |
| 4,960,295 | A | * | 10/1990 | Bodouroglou | 281/15.1 |
| 5,090,861 | A | * | 2/1992 | Malcolm et al. | 412/37 |
| 5,443,674 | A | * | 8/1995 | Fresonke et al. | 412/8 |
| 5,880,167 | A | * | 3/1999 | Krebs et al. | 521/155 |
| 6,020,429 | A | | 2/2000 | Yang et al. | |
| 6,186,721 | B1 | * | 2/2001 | Ganter | 412/22 |
| 6,207,248 | B1 | * | 3/2001 | Yang et al. | 428/102 |
| 6,479,126 | B1 | * | 11/2002 | Yang et al. | 428/102 |
| 6,548,579 | B2 | * | 4/2003 | Reski et al. | 524/47 |
| 6,607,629 | B2 | * | 8/2003 | Onusseit | 156/275.7 |
| 6,858,695 | B2 | * | 2/2005 | Schmidt et al. | 526/329.2 |

FOREIGN PATENT DOCUMENTS

| | | | |
|---|---|---|---|
| DE | 43 34 225 | | 4/1995 |
| EP | 118171 | A2 * | 9/1984 |
| EP | 232055 | A2 * | 8/1987 |
| EP | 0309736 | | 8/1988 |
| EP | 361122 | A2 * | 4/1990 |

* cited by examiner

*Primary Examiner* — Dana Ross
*Assistant Examiner* — Pradeep C Battula
(74) *Attorney, Agent, or Firm* — James E. Piotrowski; Steven C. Bauman

(57) ABSTRACT

A curable hot melt adhesive is used as a primer on a book block. A conventional thermoplastic hot melt is then applied on top of the reactive hot melt before the cover material is positioned.

15 Claims, No Drawings

BOOKBINDING PROCESS

FIELD OF THE INVENTION

The invention relates to a bookbinding process. More specifically, the invention relates to the use of a curable hot melt adhesive as a primer on a book block to, e.g., improve the rounding process of hard cover books. The invention also relates to products, including both hard and soft cover books, constructed with the use of such primer.

BACKGROUND OF THE INVENTION

In recent years, substantial interest has grown in the bookbinding, publishing and printing industries, and in the graphic arts area generally with respect to the development of improved adhesive compositions which lend themselves to bookbinding processes.

Casemaking refers to the production of the case or cover, i.e., the outer shell, of a hard bound book. During this process, the material that forms the outer covering of the book is bonded to binder boards to form a "hard" cover. Typically, the covering material is passed along a conveyor during which time binder boards are mated onto the adhesive coated covering material. The surplus covering material is folded over on to the binder board in a two step process known as "turning in" in which either the sides are folded in first and the ends are folded in second resulting in an overlap of the ends over the sides, or the ends are folded in first and the sides second.

In bookbinding processes, a number of "signatures", i.e., sheets of paper, are stacked together to form a book block which is held together by a clamp. The book block then has its spine area cut to remove any folding in the sheets that has resulted from the stacking process. The book spine then has spine glue applied to it. The spine glue may be a hot melt adhesive, an aqueous adhesive or a reactive hot melt adhesive. A primer may optionally be applied to the spine prior to application of the glue. The purpose of the primer is to ensure better adhesion of the spine glue to the spine. Once the spine glue has been applied, the cover material is then added to the book block to create the bound book.

For a hard cover book, the bound book block is then typically subjected to a conventional rounding process in order to round the spine of the finished book. One of the difficulties encountered with rounding reactive hot melt bound books off-line is that a significant amount of heat is required to soften the adhesive once cured. For rounding books on-line before the reactive hot melt adhesive has cured there are difficulties in retaining the rounded shape due to the slow crystallization of the adhesive as it cools.

During the casing-in process, the rounded book block is laminated to the inside of the cover (case) of a hard bound book by coating the outside of the end sheets of the book block with the adhesive, and then bonding the cover to the end sheets.

There is thus a need in the art for a system that can be used in bookbinding process wherein bound books can be subjected to a rounding process either on or off line without the use of extra heat or risk of the round relaxing.

SUMMARY OF THE INVENTION

The invention provides an improved bookbinding process.

One aspect of the invention is directed to a method of improving the rounding process of hard cover books wherein a curable hot melt is used as a primer on a book block. A conventional thermoplastic hot melt is then applied on top of the reactive hot melt before the cover material is positioned. The book can then be subjected to a conventional rounding process, on or off line, without the use of extra heat or risk of the round relaxing. A preferred curable hot melt for use in the practice of the invention is a reactive hot melt.

Another aspect of the invention is directed to an improved process for binding soft cover books wherein a reactive hot melt is used as a primer on a book block. A conventional thermoplastic hot melt is then applied on top of the reactive hot melt before the cover material is positioned. When used in the manufacture of soft cover books, the reactive hot melt primer will provide good adhesion and temperature resistance whilst the thermoplastic adhesive will assist in increasing the initial page pull strength as well as reducing the overall adhesive cost compared to a system that uses only reactive hot melt.

Yet another aspect of the invention is directed to bound books, both hard cover and soft cover books, wherein the book block has coated on at least one surface thereof a layer of a reactive hot melt and a layer of a thermoplastic hot melt.

DETAILED DESCRIPTION OF THE INVENTION

The disclosures of all references cited herein are incorporated in their entireties by reference.

The invention is directed to an adhesive system suitable for use in bookbinding. In the practice of the invention, a curable adhesive, preferably a reactive hot melt adhesive is used as a primer on a book block. A conventional thermoplastic hot melt is then applied on top of the reactive hot melt before the cover material is positioned.

It has been discovered that the reactive hot melt primer will cure and form a durable bond, giving a flexible book spine. The thermoplastic hot melt will comprise most of the adhesive layer and will enable the book to go through an off line rounding process for hard cover books.

As is known in the art, one of the difficulties encountered with rounding reactive hot melt bound books off-line is that a significant amount of heat is required to soften the adhesive once cured. It has now been discovered that use of the reactive hot melt as a primer only, will remove this difficulty.

Rounding books on-line before the adhesive has cured, is also known in the art to present difficulties, in particular in terms of retaining the rounded shape due to the slow crystallization of the adhesive as it cools. It has been discovered that the thermoplastic adhesive used in the practice of the invention crystallizes rapidly and holds the rounded shape. Moreover, a small amount of crosslinking between the reactive hot melt and the thermoplastic hot melt may occur at the adhesive interface, further improving the durability of the book spine.

The invention requires the use of a curable hot melt, most preferably a moisture curable hot melt, as a primer component and a thermoplastic hot melt as the spine glue component. The application of the primer (curable hot melt) and the spine glue (thermoplastic hot melt) are normally carried out by roller. Alternatively, and as would be appreciated by one skilled in the art, adhesive may be applied to the substrate by any method known in the art, and include, without limitation slot-coating, swirl spraying, extrusion, atomized spraying, gravure (pattern wheel transfer) and screen printing.

In the practice of the invention the primer coat will be applied at from about 1 to about 10 grams per square meter. The thermoplastic top coat will be applied to the primer layer directly or by lamination of a precoated paper. The amount of top coat will be from about 50 to about 100 grams per square meter. A component of the primer coat will preferably be reactive with a component of the top coat. A preferred top coat for use in the practice of the invention is an ethylene vinyl acetate based adhesive.

Various types of curable hot melts and thermoplastic hot melts which may be used in the practice of the invention are described below.

Primer

Curable hot melt adhesives which may be used in the practice of the invention include both radiation curable hot melt adhesives and reactive (i.e., moisture curable) hot melt adhesives. The term "curable" is used herein in its conventional sense as meaning capable of forming covalent cross-links. In a curable hot melt adhesive, crosslinking occurs by a variety of mechanisms depending on the formulation, such as by exposure to UV irradiation or by exposure to moisture. In radiation curable hot melt adhesives, crosslinking occurs upon exposure to actinic and/or ionizing radiation. The term "radiation" is used herein to include actinic radiation such as ultraviolet radiation and ionizing radiation created by the emission of electrons or highly accelerated nuclear particles such as neutrons, alpha-particles etc. Reactive hot melt polyurethane adhesives depend on the presence of moisture, which is obtained from the substrates or atmosphere, to cure which involves crosslinking to form tough, resilient adhesives. Reactive hot melt adhesives are also referred to as polyurethane hot melts and are preferred for use as primer.

The curable hot melt adhesives used in the practice of the invention may, desirably, be pressure sensitive or semi-pressure sensitive. As used herein, the term "pressure-sensitive adhesive" refers to a viscoelastic material which adheres instantaneously to most substrates with the application of slight pressure and remains permanently tacky. A polymer is a pressure-sensitive adhesive within the meaning of the term as used herein if it has the properties of a pressure-sensitive adhesive per se or functions as a pressure-sensitive adhesive by admixture with tackifiers, plasticizers or other additives. A semi-pressure sensitive adhesive is one which temporarily possesses sufficient tack to permanently bond the substrate. After this time the adhesive is still permanently tacky but not enough to create a strong bond. Semi-pressure sensitive adhesives are typically used as regular hot melts. That is the bond is made while the adhesive is still molten. The fact that bondable tack extends through the solidification stage creates the opportunity to bond over a wide process range. One cannot coat these types of adhesive and create a bond with them at a later date as with a true pressure sensitive.

Polyurethane hot melt adhesives are comprised of isocyanate-terminated polyurethane polymers, often referred to as "prepolymers," that react with surface or ambient moisture in order to chain-extend and form a second polyurethane polymer.

Unlike conventional hot melt adhesives, which can be heated to a liquid state and cooled to a solid state repeatedly, a reactive hot melt undergoes an irreversible chemical reaction to a solid "cured" form once dispensed in the presence of ambient moisture.

The urethane prepolymers are those conventionally used in the production of polyurethane hot melt adhesive compositions. Any suitable compound which contains two or more isocyanate groups may be used for preparing the urethane prepolymers. Typically from about 5 to about 75 parts by weight of an isocyanate is used.

Organic polyisocyanate which may be used to practice the invention include alkylene diisocyanates, cycloalkylene diisocyanates, aromatic diisocyanates and aliphatic-aromatic diisocyanates. Specific examples of suitable isocyanate-containing compounds include, but are not limited to, ethylene diisocyanate, ethylidene diisocyanate, propylene diisocyanate, butylene diisocyanate, trimethylene diisocyanate, hexamethylene diisocyanate, toluene diisocyanate, cyclopentylene-1,3-diisocyanate, cyclo-hexylene-1,4-diisocyanate, cyclohexylene-1,2-diisocyanate, 4,4'-diphenylmethane diisocyanate, 2,2-diphenylpropane-4,4'-diisocyanate, xylylene diisocyanate, 1,4-naphthylene diisocyanate, 1,5-naphthylene diisocyanate, m-phenylene diisocyanate, p-phenylene diisocyanate, diphenyl-4,4'-diisocyanate, azobenzene-4,4'-diisocyanate, diphenylsulphone-4,4'-diisocyanate, 2,4-tolylene diisocyanate, dichlorohexamethylene diisocyanate, furfurylidene diisocyanate, 1-chlorobenzene-2,4-diisocyanate, 4,4',4"-triisocyanatotriphenylmethane, 1,3,5-triisocyanato-benzene, 2,4,6-triisocyanato-toluene, 4,4'-dimethyldiphenyl-methane-2,2',5,5-tetratetraisocyanate, and the like. While such compounds are commercially available, methods for synthesizing such compounds are well-known in the art. Preferred isocyanate-containing compounds are methylenebisphenyidiisocyanate (MDI), isophoronediisocyanate (IPDI) and toluene diisocyanate (TDI).

Most commonly, the prepolymer is prepared by the condensation polymerization of a polyisocyanate with a polyol, most preferably the polymerization of a diisocyanate with a diol. The polyols used include polyhydroxy ethers (substituted or unsubstituted polyalkylene ether glycols or polyhydroxy polyalkylene ethers), polyhydroxy polyesters, the ethylene or propylene oxide adducts of polyols and the monosubstituted esters of glycerol, as well as mixtures thereof. The polyol is typically used in an amount of between about 1 to about 70 parts by weight.

Examples of polyether polyols include a linear and/or branched polyether having plural numbers of ether bondings and at least two hydroxyl groups, and contain substantially no functional group other than the hydroxyl groups. Examples of the polyether polyol may include polyoxyalkylene polyol such as polyethylene glycol, polypropylene glycol, polybutylene glycol and the like. Further, a homopolymer and a copolymer of the polyoxyalkylene polyols may also be employed. Particularly preferable copolymers of the polyoxyalkylene polyols may include an adduct at least one compound selected from the group consisting of ethylene glycol, propylene glycol, diethylene glycol, dipropylene glycol, triethylene glycol, 2-ethylhexanediol-1,3, glycerin, 1,2,6-hexane triol, trimethylol propane, trimethylol ethane, tris(hydroxyphenyl)propane, triethanolamine, triisopropanolamine, ethylenediamine and ethanolamine; with at least one compound selected from the group consisting of ethylene oxide, propylene oxide and butylene oxide.

A number of suitable polyols are available commercially. By way of example only, there is mentioned CP4701 (Dow Chemicals), Niax 11-34 (Union Carbide Corp), Desmophen 3900 (Bayer), Propylan M12 (Lankro Chemicals), Highflex 303 (Daiichi Kogyo Seiyaku K.K.) and Daltocel T 32-75 (ICI). "Polymer polyols" are also suitable, i.e. graft polyols containing a proportion of a vinyl monomer, polymerised in situ, e.g., Niax 34-28.

Polyester polyols are formed from the condensation of one or more polyhydric alcohols having from 2 to 15 carbon atoms with one or more polycarboxylic acids having from 2 to 14 carbon atoms. Examples of suitable polyhydric alcohols include ethylene glycol, propylene glycol such as 1,2-propylene glycol and 1,3-propylene glycol, glycerol, pentaerythritol, trimethylolpropane, 1,4,6-octanetriol, butanediol, pentanediol, hexanediol, dodecanediol, octanediol, chloropentanediol, glycerol monallyl ether, glycerol monoethyl ether, diethylene glycol, 2-ethylhexanediol-1,4, cyclohexanediol-1,4,1,2,6-hexanetriol, 1,3,5-hexanetriol, 1,3-bis- (2-hydroxyethoxy)propane and the like. Examples of polycarboxylic acids include phthalic acid, isophthalic acid, terephthalic acid, tetrachlorophthalic acid, maleic acid, dodecylmaleic acid, octadecenylmaleic acid, fumaric acid, aconitic acid, trimellitic acid, tricarballylic acid, 3,3'-thiodipropionic acid, succinic acid, adipic acid, malonic acid, glutaric acid, pimelic acid, sebacic acid, cyclohexane-1,2-dicarboxylic acid, 1,4-cyclohexadiene-1,2-dicarboxylic acid, 3-methyl-3,5-cyclohexadiene-1,2-dicarboxylic acid and the corresponding acid anhydrides, acid chlorides and acid esters such as phthalic anhydride, phthaloyl chloride and the dimethyl ester of phthalic acid. Preferred polycarboxylic acids are the aliphatic and cycloaliphatic dicarboxylic acids containing no more than 14 carbon atoms and the aromatic dicarboxylic acids containing no more than 14 atoms.

In addition, the urethane prepolymers may be prepared by the reaction of a polyisocyanate with a polyamino or a polymercapto-containing compound such as diamino polypropylene glycol or diamino polyethylene glycol or polythioethers such as the condensation products of thiodiglycol either alone or in combination with other glycols such as ethylene glycol, 1,2-propylene glycol or with other polyhydroxy compounds disclosed above. In accordance with one embodiment of the invention, the hydroxyl containing acrylic polymer may function as the polyol component, in which case, no additional polyol need be added to the reaction.

Further, small amounts of low molecular weight dihydroxy, diamino, or amino hydroxy compounds may be used such as saturated and unsaturated glycols, e.g., ethylene glycol or condensates thereof such as diethylene glycol, triethylene glycol, and the like; ethylene diamine, hexamethylene diamine and the like; ethanolamine, propanolamine, N-methyidiethanolamine and the like.

The reactive hot melt adhesive may also be modified by incorporation of acrylic polymers, as describe in U.S. Pat. Nos. 5,021,507 and 5,866,656, and/or by incorporation of ethylene vinyl acetate copolymers.

In a preferred embodiment of the invention, the urethane is modified by the incorporation of acrylic resins, in particular reactive hydroxy-containing and non-reactive acrylic copolymers. Preferably between about 0 to about 80%, more preferably from about 0 to about 40%, most preferably from about 15 to aobut 35%, by weight of the hydroxylated and or non-hydroxylated acrylic polymer is present in the in the adhesive composition.

Virtually any ethylenically unsaturated monomer containing hydroxyl functionality greater than one may be utilized in the compositions of the present invention. Most commonly employed are hydroxyl substituted $C_1$ to $C_{12}$ esters of acrylic and methacrylic acids including, but not limited to hydroxyl substituted methyl acrylate, ethyl acrylate, n-butyl acrylate, 2-ethylhexyl acrylate, isobutyl acrylate, n-propyl or iso-propyl acrylate or the corresponding methacrylates. Mixtures of compatible (meth)acrylate monomers may also be used. Additional monomers that may be used include the hydroxyl substituted vinyl esters (vinyl acetate and vinyl propionate), vinyl ethers, fumarates, maleates, styrene, acrylonitrile, etc. as well as comonomers thereof.

If used as monomers, these monomers are blended with other copolymerizable comonomers as formulated so as to have a wide range of Tg values, as between about −48° C. and 105° C., preferably 15° C. to 85° C. Suitable comonomers include the $C_1$ to $C_{12}$ esters of acrylic and methacrylic acids including, but not limited to methyl acrylate, ethyl acrylate, n-butyl acrylate, isobutyl acrylate, 2-ethylhexyl acrylate, n-propyl or iso-propyl acrylate or the corresponding methacrylates. Mixtures of compatible (meth)acrylate monomers may also be used. Additional monomers that may be used include the vinyl esters (vinyl acetate and vinyl propionate), vinyl ethers, fumarates, maleates, styrene, acrylonitrile, ethylene, etc. as well as comonomers thereof.

The hydroxyl containing monomers may be the same or different from the monomers used in the remainder of the acrylic polymerization. The particular monomers selected will depend, in large part, upon the end use for which the adhesives are intended. Thus, adhesives to be used in pressure sensitive applications or in applications wherein adhesion to metal is required will be selected to obtain a lower Tg polymer than may be desired in non-pressure sensitive applications or those involving more easily bonded substrates.

When the adhesive is to be prepared utilizing monomeric materials, the respective monomers may be added to the polyols and polymerized therein prior to formation of the prepolymer or may be added to the already formed prepolymer and the acrylic polymerization subsequently performed. In the case of polyamino or polymercapto containing prepolymers, in-situ vinylic polymerization must be performed only in the pre-formed prepolymer.

The hydroxyl containing ethylenically unsaturated monomer is polymerized using conventional free radical polymerization procedures to a relatively low molecular weight. For purposes of clarification herein, by "low molecular weight" is meant number average molecular weights in the range of approximately 2,000 to 25,000, preferably 4,000 to 15,000. Molecular weight distribution is characterized by Gel Permeation Chromatography using a PL Gel, Mixed 10 micron column, a Shimadzu Model RID 6A Detector with a tetrahydrofuran carrier solvent at a flow rate of 1 milliliter per minute. The low molecular weight is obtained by careful monitoring and controlling the reaction conditions and, generally, by carrying out the reaction in the presence of a chain transfer agent such as dodecyl mercaptan. Subsequent to the polymerization of the ethylenically unsaturated monomer(s), the polyisocyanate and any additional ingredients required for the urethane prepolymer forming reaction are added and that reaction is carried out using conventional condensation polymerization procedures. In this manner, the resultant isocyanate terminated urethane prepolymer forms the reactive curing hot melt adhesive described above which contains about 10 to 70% of the urethane prepolymer and 30 to 90% of the low molecular weight hydroxyl containing polymer.

It is also possible to polymerize the low molecular weight polymer in the presence of the already formed isocyanate terminated urethane prepolymer. This method has the drawback of subjecting the prepolymer to unnecessary heating during the acrylic polymerization, heating that might result in branching, viscosity increase, depletion of needed isocyanate groups and possible gellation. Although these disadvantages are subject to control, more stringent control of conditions are required as compared to polymerization in the non-isocyanate functional urethane components. When the reaction is run in the polyol or other non-isocyanate containing component, there is also the advantage of lower reaction viscosities and reduced exposure to isocyanate vapors because of the lesser amount of heating required.

Optionally, the hydroxyl containing functionality may be introduced into the adhesive in the form of pre-polymerized low molecular weight hydroxyl containing polymers. In the latter case, typical polymers include hydroxyl substituted butyl acrylate, hydroxylated butyl acrylate/methyl methacrylate copolymers, hydroxylated ethyl acrylate/methyl methacrylate copolymers, and the like, the polymers having a number average molecular weight of 2,000 to 25,000 and a hydroxyl number of 5 to 15. If used in the form of low molecular weight polymers, the polymers may be blended with the polyol prior to reaction thereof with the isocyanate or they may be added directly to the isocyanate terminated prepolymer.

Preferred adhesives of the invention typically comprise from about 5 to about 50 parts by weight of an isocyante, from about 1 to about 70 parts by weight of a polyol, and from about 0 to about 80 parts by weight of an acrylic copolymer. The polyol may be a polyester polyol, a polyether polyol or a combination thereof.

While the adhesives may be used directly as described above, if desired the adhesives of the present invention may also be formulated with conventional additives that are compatible with the composition. Such additives include plasticizers, compatible tackifiers, catalysts, fillers, antioxidants, pigments, adhesion promotors, stabilizers and the like. The reactive hot melt adhesives of the invention may also contain flame retardant components. Fire retardant additives known in the art for imparting flame resistance to polyurethane compositions may be added. Conventional additives which are compatible with a composition according to this invention may simply be determined by combining a potential additive with the composition and determining if they are compatible. An additive is compatible if it is homogenous within the product.

While moisture curable hot melts are preferred for use, radiation curable adhesives may also be used in the practice of the adhesive. Preferred radiation curable adhesives comprise at least one high vinyl block copolymer. High vinyl block styrene-butadiene-styrene copolymers and/or styrene-isoprene-styrene copolymers are preferred. While radial and linear block copolymers are preferred for use, other block copolymer morphologies can be used as would be recognized by those skilled in the art. The term bock copolymers include di-block, tri-block and mult-block copolymers.

Examples of radiation curable hot melt adhesives which may be used in the practice of the invention will typically comprise from about 5% to about 40% by weight of at least one high vinyl block styrene-butadiene copolymer; from about 30% to about 80% by weight of at least one solid tackifier; from about 0.05% to about 5% by weight of at least one photoinitiator; up to about 15% by weight of at least one high vinyl, linear styrene-butadiene-styrene or multi-block styrene-butadiene copolymer; up to about 15% by weight of at least one high diblock conventional low vinyl styrene-butadiene-styrene or styrene-isoprene-styrene block copolymer; up to about about 40% by weight of at least one oil or liquid tackifier; and up to about 3% by weight of at least one antioxidant.

Suitable high vinyl styrene-butadiene block copolymers include, but are not limited to, four arm radial multi-block styrene-butadiene copolymers comprising 60% vinyl, 26% styrene and a relatively broad molecular weight distribution (Mn=94,200 and Mw=276,100). Such block copolymers include SR8296 available from Firestone.

Suitable high vinyl linear styrene-butadiene block copolymers include, but are not limited to, linear multi-block styrene-butadiene copolymers having 57% vinyl, 44% styrene, melt index=13 (cond. G), (Mw=85,000 and Mn=54,000). Such copolymers include STEREON 857 available from Firestone.

Suitable high diblock conventional low vinyl styrene-butadiene-styrene, or SIS, block copolymers include Asaprene JT38; Kraton D1119; Quintac SL117; SR 8219.

Multi-block copolymers may be prepared by a variety of methods. One such method is described in U.S. Pat. No. 3,937,760 (The Firestone Tire & Rubber Company). A typical multi-block copolymer is SR8296. This is a four arm radial multi-block styrene-butadiene copolymer comprising 60% vinyl, 26% styrene and a relatively broad molecular weight distribution (Mn=94,200 and Mw=276,100) and is available from Firestone.

Solid hydrogenated tackifying resins are useful in the radiation curable composition of the invention in concentrations ranging from about 30% by weight to about 80% by weight, preferably in amounts ranging from about 45% by weight to about 70%, more preferably from about 50% by weight to about 65% by weight.

Representative tackifying resins include the $C_5/C_9$ hydrocarbon resins, synthetic polyterpenes, rosin, rosin esters, natural terpenes, and the like. More particularly, the useful tackifying resins include any compatible resins or mixtures thereof such as (1) natural and modified rosins including gum rosin, wood rosin, tall oil rosin, distilled rosin, hydrogenated rosin, dimerized rosin, and polymerized rosin; (2) glycerol and pentaerythritol esters of natural and modified rosins, including the glycerol ester of pale, wood rosin, the glycerol ester of hydrogenated rosin, the glycerol ester of polymerized rosin, the pentaerythritol ester of hydrogenated rosin, and the phenolic-modified pentaerythritol ester of rosin; (3) copolymers and terpolymers of natural terpenes, such as styrene/terpene and alpha methyl styrene/terpene; (4) polyterpene resins generally resulting from the polymerization of terpene hydrocarbons, such as the bicyclic monoterpene known as pinene, in the presence of Friedel-Crafts catalysts at moderately low temperatures; also included are the hydrogenated polyterpene resins; (5) phenolic modified terpene resins and hydrogenated derivatives thereof such, for example, as the resin product resulting from the condensation, in an acidic medium, of a bicyclic terpene and a phenol; (6) aliphatic petroleum hydrocarbon resins resulting from the polymerization of monomers consisting primarily of olefins and diolefins; also included are the hydrogenated aliphatic petroleum hydrocarbon resins; and (7) cyclic petroleum hydrocarbon resins and the hydrogenated derivatives thereof. Also included are the cyclic or acyclic $C_5$ resins and aromatic modified acyclic or cyclic resins. Preferred are hydrogenated, cyclic or $C_5$ resins, such as ESCOREZ 5400 (Exxon), hydrogenated aromatic modified cyclic resin ESCOREZ 5600 (Exxon). Mixtures of two or more of the above described tackifying resins may be required for some formulations.

The photoinitiators are typically employed in concentrations ranging from about 0.05% by weight to about 5% by weight, preferably in amounts ranging from about 0.2% by weight to about 3% by weight, more preferably from about 0.5% by weight to about 1.5% by weight. The concentration is chosen based on the thickness of the application of the uncured radiation curable composition. Combinations of two or more photinitiators may also be used. Commercial examples include Irgacure 651, 184 and 1700 and Darocur 1173, available from Ciba-Geigy as well as Genocure LBP available from Rahn, and Esacure KIP150 available from Sartomer. Other examples of photoinitiators include benzophenone, benzyldimethyl ketal, isopropylthioxanthone, bis(2,6-dimethoxybenzoyl)(2,4,4-trimethylpentyl) phosphineoxide, 2-hydroxy-2-methyl-1-phenyl-1-propanone, diphenyl(2,4,6-trimethybenzoyl)phosphine oxides, 1-hydroxycyclohexyl phenyl ketone, 2-benzyl-2-(dimethylamino)-1→4-(4-morpholinyl)phenyl-1-butanone, alpha,alpha-dimethoxy-alpha-phenylacetophenone, 2,2-diethoxyacetophenone, 2-methyl-1→4-(methylthio)phenyl-2-(4-morpholinyl)-1-propanone, and 2-hydroxy-1-4-(hydroxyethoxy)phenyl-2-methyl-1-propanone.

Combinations of photoinitiators may be used to achieve the best possible cure of adhesive compositions. Photoinitiators are preferably used in the least amount necessary to get initiation of cure at the line speed of the process. The cure process is generally more efficient in the absence of oxygen, for example, in the presence of nitrogen, so a greater amount of photoinitiator is generally required in the presence of oxygen.

The hot melt adhesive of the present invention may also comprise about 0% by weight to about 40% by weight of an oil diluent. Suitable plasticizing or extending oils include olefin oligomers and low molecular weight polymers as well as vegetable and animal oil and their derivatives. The petroleum derived oils which may be employed are relatively high boiling materials containing only a minor proportion of aromatic hydrocarbons (preferably less than 30% and, more particularly, less than 15% by weight of the oil). Alternatively, the oil may be totally non-aromatic. Suitable oligomers include polypropylenes, polybutenes, hydrogenated polyisoprene, hydrogenated polybutadiene, or the like having average molecular weights between about 350 and about 10,000. Preferred are LUMINOL T350, a mineral oil available from Petrocanada and KAYDOL OIL available from Witco Corporation.

Antioxidants are typically added to the commercially available compounds in order to protect the ingredients against degradation during preparation and use of the adhesive compositions, however without interfering with the irradiation curing of the polymer. Combinations of antioxidants are often more effective due to the different mechanisms of degradation to which various polymers are subject. Certain hindered phenols, organo-metallic compounds, aromatic amines, aromatic phosphites, and sulphur compounds are useful for this purpose. Examples of effective types of these materials include phenolic antioxidants, thio compounds, and tris-(nonylated phenyl) phosphites.

Examples of commercially available antioxidants include IRGANOX 1010 (pentaetythrityl-tetrakis[3-(3,5-di-tert-butyl-4-hydroxyphenyl)propionate); IONOL (2,6-di-tertiary-butyl-4-methyl phenol); IONOX 330 (3,4,6-tris (3,5-di-tertiary-butyl-p-hydroxybenzyl)-1,3,5-trimethylbenzene); and POLYGARD HR (tris-(2,4-di-tertiary-butyl-phenyl) phosphite).

To ensure long-term thermal stability, in general from about 0.1% to about 3% by weight of one or more antioxidants is included in the adhesive compositions, preferably from about 0.4% by weight to about 1.5% by weight.

Additional materials may be added optionally to the adhesive composition at up to about 15% by weight, preferably from about 5% by weight to about 10% by weight, dependent on the intended end-use of the adhesive. Such additional materials include, without limitation, block copolymers of monovinyl aromatic hydrocarbons and conjugated dienes such as polystyrene-polybutadiene-polystyrene, polystyrene-polyisoprene-polystyrene, poly(alpha-methyl-styrene) polybutadiene-poly(alpha-methyl-styrene), poly(alpha-methyl-styrene)-polyisoprene-poly(alpha-methyl-styrene), as well as the hydrogenated modifications thereof, e.g. polystyrenepoly(ethylene-butylene)-polystyrene and polystyrene-poly(ethylene-propylene)-polystyrene. These copolymers may be prepared by methods taught, for example, in U.S. Pat. Nos. 3,239,478; 3,247,269; 3,700,633; 3,753,936; and 3,932,327, and are available from several manufacturers, including Shell Chemical Co. under the trade name KRATON.

Other non-limiting examples of additional materials include SBR random copolymers with low (<20%) or high (>20%) vinyl contents, available under the tradename DURADENE from Firestone (these high vinyl copolymers are reactive and contribute to the crosslinking of the system); EPDM copolymers which can react into the polymer network via unsaturated sites, and saturated analogs (e.g. EP rubber) that can modify the peel and tack of the adhesive and which are available from Exxon under the trade name VISTALON; butyl rubber, which is a copolymer of isoprene and isobutylene and is available from Exxon Chemical Company under the trade name SB BUTYL; Polyisobutylene, available from Exxon Chemical Company under the trade name VISTANEX; and liquid polyisopropylene such as is available from Kuraray Inc. under the trade name LIR.

In addition to the above-described additional materials, the various compositions of the present invention may include other additives known to those skilled in the art. These additives may include, but are not limited to, pigments, fillers, fluorescent additives, flow and leveling additives, wetting agents, surfactants, antifoaming agents, rheology modifiers, stabilizers, and antioxidants. Preferred additives are those which do not have appreciable absorption in the wavelengths of interest.

Examples of pigments and filler materials include, but are not limited to, titanium dioxide, hydrophobic amorphous fumed silica, amorphous precipitated silica, carbon black, and polymer powders. Examples of flow and leveling additives, wetting agents, and antifoaming agents include silicones, hydrocarbons, fluorine-containing compounds, and non-silicone polymers and copolymers such as copolyacrylates.

Other materials which may be added optionally to the adhesive composition include endblock resins which are substantially aromatic. Examples of such endblock resins can be prepared from any substantially aromatic monomers having a polymerizable unsaturated group. Typical examples of such aromatic monomers include the styrenic monomers, styrene, alpha-methyl styrene, vinyl toluene, methoxy styrene, tertiary butyl styrene, chloro styrene, etc., indene monomers including indene, and methyl indene. The aromatic endblock resin is preferably present in amounts of 5 to 20 weight percent. Preferred is HERCOLITE 240 or KRISTALEX 5140, both of which are alpha methyl styrene resins available from Hercules, Inc.

In a preferred embodiment of the present invention the adhesive composition comprises from about 20% to about 30% by weight block styrene-butadiene copolymer having about 60% by weight vinyl and about 26% by weight styrene; from about 45% to about 60% by weight of a hydrogenated tackifier resin; from about 0.5% to about 1.5% by weight of a photoinitiator; from about 10% to about 20% by weight of a white mineral oil; from about 0% to about 0.5% by weight of an acrylic antioxidant, from about 0% to about 0.5% by weight of a thioester antioxidant, and from about about 0% to about 0.5% by weight of a hindered phenol antioxidant; and from about 0% to about 10% by weight of a diblock copolymer.

The adhesive compositions of the invention are prepared by conventional methods. As an example, the block copolymers, the tackifying resin and other desired components may be blended at an elevated temperature, (e.g. temperature of about 300° F.) using an extruder, a Z-blade mixer or other conventional mixing device. A preferred method employs the process as disclosed in U.S. Pat. No. 3,937,760, the disclosure of which is incorporated herein by reference.

Thermoplastic Hot Melt

Hot melt adhesives are 100% solid materials which do not contain or require any solvent and are solid at room temperature. On application of heat, a hot melt adhesive melts to a liquid or fluid state in which form it is applied to a substrate. On cooling, the hot melt adhesive regains its solid form, thereby gaining its cohesive strength. Hot melt adhesives can be heated to a liquid state and cooled to a solid state repeatedly.

Any base polymer suitable for use in formulating hot melt adhesives, as are well known to those skilled in the art may be used in the practice of the invention. Such polymers include amorphous polyolefins, ethylene-containing polymers and rubbery block copolymers, as well as blends thereof. Hot melt adhesive compositions based on ethylene/vinyl acetate copolymers, isotactic or atactic polypropylene, styrene-butadiene, styrene-isoprene, or styrene-ethylene-butylene A-B-A or A-B-A-B block copolymers or mixtures thereof may be used. In addition to the base polymer, the hot melt adhesive compositions of the invention may also contain tackifiers, oils and/or waxes as well as conventional additives including stabilizers, anti-oxidants, pigments and the like.

Ethylene containing polymers are commonly used in the manufacture of hot melt adhesives. The adhesive of the invention may comprise at least one ethylene copolymer, and may comprise a blend of two or more polymers. The term ethylene copolymer, as used herein, refers to homopolymers, copolymers and terpolymers of ethylene. Examples of ethylene copolymers include copolymers with one or more polar monomers which can copolymerize with ethylene, such as vinyl acetate or other vinyl esters of monocarboxylic acids, or acrylic or methacrylic acid or their esters with methanol, ethanol or other alcohols. Included are ethylene vinyl acetate, ethylene methyl acrylate, ethylene n-butyl acrylate, ethylene acrylic acid, ethylene methacrylate and mixtures and blends thereof. Random and block copolymers, as well as blends thereof may be used in the practice of the invention.

Adhesives based on rubbery block copolymers may be used. These polymers include the block or multi-block copolymers having the general configuration: A-B-A or A-B-A-B-A-B— wherein the polymer blocks A are non-elastomeric polymer blocks which, as homopolymers have glass transition temperatures above 20° C., while the elastomeric polymer blocks B are butadiene or isoprene or butadiene isoprene which is partially or substantially hydrogenated. Further, they may be linear or branched. Typical branched structures contain an elastomeric portion with at least three branches which can radiate out from a central hub or can be otherwise coupled together.

The non-elastomeric blocks may comprise homopolymers or copolymers of vinyl monomers such as vinyl arenes, vinyl pyridines, vinyl halides and vinyl carboxylates, as well as acrylic monomers such as acrylonitrile, methacrylonitrile, esters of acrylic acids, etc. Monovinyl aromatic hydrocarbons include particularly those of the benzene series such as styrene, vinyl toluene, vinyl xylene, ethyl vinyl benzene as well as dicyclic monovinyl compounds such as vinyl naphthalene and the like. Other non-elastomeric polymer blocks may be derived from alpha olefins, alkylene oxides, acetals, urethanes, etc.

The elastomeric block component of the copolymer may be isoprene or butadiene which may or may not be hydrogenated. This hydrogenation may be either partial or substantially complete. Selected conditions may be employed for example to hydrogenate the elastomeric block while not so modifying the vinyl arene polymer blocks. Other conditions may be chosen to hydrogenate substantially uniformly along the polymer chain, both the elastomeric and non-elastomeric blocks thereof being hydrogenated to practically the same extent, which may be either partial or substantially complete.

Typical of the rubbery block copolymers useful herein are the polystyrene-polybutadienepolystyrene, polystyrene-polyisoprene-polystyrene and e.g., polystyrene-poly-(ethylenebutylene)-polystyrene and polystyrene-poly-(ethylenepropylene)-polystyrene. These copolymers may be prepared using methods taught, for example, in U.S. Pat. Nos. 3,239,478; 3,427,269; 3,700,633; 3,753,936; and 3,932,327. Alternatively, they may be obtained from Shell Chemical Co. under the trademarks Kraton 1101, 1102, 1107, 1650, 1652 and 1657; from Enichem under the Europrene Sol-T tradenames; and from Firestone under the tradename Stereon 840A.

Other adhesive compositions may be prepared according to the invention using, as a base polymer, amorphous polyolefins or blends thereof. Amorphous polyolefins are made by the stereospecific polymerization of polypropylene. Suitable commercial products include Eastman's P 1010. Copolymers of amorphous polypropylene and ethylene, amorphous polypropylene and butene and amorphous polypropylene and hexene are suitable as a base polymer, as are terpolymers of propylene, butene and ethylene. Commercial examples include Rextac 2315 (copolymer of amorphous polypropylene and ethylene) available from Rexene, Rextac 2730 (copolymer of amorphous polypropylene and butene) also available from Rexene and Vestoplast 750 and 708 (terpolymers of amorphous propylene, butene and ethylene) available from Huls.

Blends of any of the above base materials, such as blends of ethylene n-butyl acrylate and ethylene vinyl acetate and ethylene vinyl acetate and atactic polypropylene may also be used to prepare hot melt adhesive compositions. In all cases, the adhesives may be formulated with tackifying resins, plasticizers, waxes and/or other conventional additives in varying amounts as are known to those skilled in the art and as required for particular formulations, e.g., a pressure sensitive adhesive formulation.

Tackifying resins useful in the adhesive compositions of this invention include hydrocarbon resins, synthetic polyterpenes, rosin esters, natural terpenes, and the like. More particularly, and depending upon the particular base polymer, the useful tackifying resins may include any compatible resins or mixtures thereof such as natural and modified rosins including, for example, as gum rosin, wood rosin, tall oil rosin, distilled rosin, hydrogenated rosin, dimerized rosin, and polymerized rosin; glycerol and pentaerythritol esters of natural and modified rosins, including, for example as the glycerol ester of pale, wood rosin, the glycerol ester of hydrogenated rosin, the glycerol ester of polymerized rosin, the pentaerythritol ester of hydrogenated rosin, and the phenolic-modified pentaerythritol ester of rosin; copolymers and terpolymers of natured terpenes, including, for example, styrene/terpene and alpha methyl styrene/terpene; polyterpene resins having a softening point, as determined by ASTM method E28-58T, of from about 80° C. to 150° C.; phenolic modified terpene resins and hydrogenated derivatives thereof including, for example, the resin product resulting from the condensation, in an acidic medium, of a bicyclic terpene and a phenol; aliphatic petroleum hydrocarbon resins having a Ball and Ring softening point of from about 70° C. to 135° C.; aromatic petroleum hydrocarbon resins and the hydrogenated derivatives thereof; and alicyclic petroleum hydrocarbon resins and the hydrogenated derivatives thereof. Mixtures of two or more of the above described tackifying resins may be required for some formulations.

Various plasticizing or extending oils are also present in the composition in amounts of 5% to about 30%, preferably 5 to 25%, by weight in order to provide wetting action and/or viscosity control. Even higher levels may be used in cases where block copolymer containing hydrogenated mid-block are employed as the adhesive base polymer. The above broadly includes not only the usual plasticizing oils but also contemplates the use of olefin oligomers and low molecular weight polymers as well as vegetable and animal oil and their derivatives. The petroleum derived oils which may be employed are relatively high boiling materials containing only a minor proportion of aromatic hydrocarbons (preferably less than 30% and, more particularly, less than 15% by weight of the oil). Alternatively, the oil may be totally non-aromatic. The oligomers may be polypropylenes, polybutenes, hydrogenated polyisoprene, hydrogenated polybutadiene, or the like having average molecular weights between about 350 and about 10,000. Vegetable and animal oils include glyceryl esters of the usual fatty acids and polymerization products thereof.

Various petroleum derived waxes may also be used in amounts less than about 15% by weight of the composition in order to impart fluidity in the molten condition of the adhesive and flexibility to the set adhesive, and to serve as a wetting agent for bonding cellulosic fibers. The term "petroleum derived wax" includes both paraffin and microcrystalline waxes having melting points within the range of 130° F. to 225° F. as well as synthetic waxes such as low molecular weight polyethylene or Fisher-Tropsch waxes.

An antioxidant or stabilizer may also be included in the adhesive compositions described herein in amounts of up to about 3% by weight. Among the applicable antioxidants or stabilizers are high molecular weight hindered phenols and multifunctional phenols such as sulfur and phosphorous-containing phenols. Representative hindered phenols include: 1,3,5-trimethyl 2,4,6-tris (3,5-di-tert-butyl-4-hydroxy-benzyl)benzene; pentaerythritol tetrakis-3(3,5-di-tert-butyl-4-hydroxyphenyl)-propionate; n-octadecyl-3,5-di-tert-butyl-4-hydroxyphenol)-propionate; 4,4'-methylenebis (2,6-tert-butylphenol); 4,4'-thiobis (6-tert-butyl-o-cresol); 2,6-di-tertbutylphenol; 6-(4-hydroxyphenoxy)-2,4-bis(n-octyl-thio)-1,3,5-triazine; di-n-octadecyl 3,5-di-tert-butyl-4-hydroxy-benzyl-phosphonate; 2n-octylthio)-ethyl 3,5-di-tert-butyl-4hydroxy-benzoate and sorbitol hexa[3-(3,5-ditert-butyl-4-hydroxyphenyl)-propionate].

Other additives conventionally used in hot melt adhesives to satisfy different properties and meet specific application requirements also may be added to the adhesive composition of this invention. Such additives include, for example, fillers, pigments, flow modifiers, dyestuffs, which may be incorporated in minor or larger amounts into the adhesive formulation, depending on the purpose.

Hot melt adhesives may be prepared using techniques known in the art. Typically, the adhesive compositions are prepared by blending the components in the melt at a temperature of about 100° to 200° C. until a homogeneous blend is obtained, approximately two hours. Various methods of blending are known and any method that produces a homogeneous blend is satisfactory.

The invention can be illustrated by the following non-limiting examples.

EXAMPLES

Example 1

Ten book samples were produced by hand on a conventional bookbinding machine. PURFECT 282, a reactive hot melt adhesive available from National Starch and Chemical Company, was applied to the book sample at a coat weight of 0.1 mm thick. An ethylene vinyl acetate based hot melt (TWINFLEX R513, available from National Starch and Chemical Company) was immediately applied on top of the reactive hot melt to increase the total adhesive thickness to 0.7 mm. A lining material was used as the cover and the book samples were left for 8 weeks. The bound book blocks were then run through a standard process whereby the spine was rounded and a hard cover was attached to the book. No extra heat or processing was required. The rounded books were of high quality, giving page pull strengths and adhesion equivalent to books bound with reactive hot melt only.

Example 2

Soft cover book samples were produced by hand on a conventional bookbinding machine. PURFECT 254, a reactive hot melt adhesive available from National Starch and Chemical Company, was applied to the book sample at a thickness of 0.1 mm. An ethylene vinyl acetate based hot melt (INSTANT-FLEX 123), available from National Starch and Chemical Company, was immediately applied on top of the reactive hot melt to increase the total adhesive thickness to 0.7 mm. A conventional soft cover was applied and the books were run through a standard trimming process at a rate of 6500 clamps per hour. The finished books had a pleasing square spine and page pull strength was excellent.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

The invention claimed is:

1. A method of improving the rounding process of hard cover books comprising the following steps, in the order of (1) applying a curable hot melt as a primer layer on a surface of a book block, (2) applying to said primer layer a thermoplastic hot melt, (3) applying a cover material, and (4) rounding the spine of the book.

2. The method of claim 1 wherein the curable hot melt is a reactive hot melt.

3. The method of 2 wherein the thermoplastic hot melt comprises ethylene vinyl acetate.

4. A process for binding books comprising applying a curable hot melt as a primer on a book block, applying to said curable hot melt a thermoplastic hot melt, and applying a cover material.

5. The process of claim 4 wherein the curable hot melt is a reactive hot melt.

6. The process of 5 wherein the thermoplastic hot melt comprises ethylene vinyl acetate.

7. The process of claim 4 wherein the book is a hard cover book.

8. A book prepared using the process of claim 7.

9. The process of claim 4 wherein the book is a soft cover book.

10. A book prepared using the process of claim 9.

11. A method of improving the rounding process of hard cover books comprising the following steps, applying a curable hot melt as a primer layer on a surface of a book block, applying to said primer layer a thermoplastic hot melt, applying a cover material, and rounding the spine of the book wherein the curable hot melt comprises a radiation curable hot melt or a moisture curable hot melt.

12. The method of claim 11 further comprising the following steps: choosing a curable hot melt adhesive; and choosing a thermoplastic hot melt so that crosslinking with the curable hot melt adhesive can occur.

13. The method of claim 11, wherein the following steps are performed in the order of (1) applying a melted curable hot melt as a primer layer on a surface of a book block, (2) applying to said primer layer a melted thermoplastic hot melt, (3) applying a cover material, and (4) rounding the spine of the book.

14. The method of claim 11, wherein the primer layer is applied at from 1 to 10 grams per square meter and the thermoplastic hot melt is applied at from 50 to 100 grams per square meter.

15. The method of claim 11, wherein the curable hot melt comprises a urethane prepolymer and the thermoplastic hot melt comprises ethylene vinyl acetate.

* * * * *